US005347752A

United States Patent [19]

Black

[11] Patent Number: 5,347,752

[45] Date of Patent: Sep. 20, 1994

[54] FLOWER CARE, STORAGE AND DISPLAY DEVICE

[76] Inventor: Kevin E. Black, 3129 NE. 13th #24, Gresham, Oreg. 97030

[21] Appl. No.: 901,425

[22] Filed: Jun. 19, 1992

[51] Int. Cl.[5] ..... A01G 5/00

[52] U.S. Cl. ..... 47/41.11; 248/911

[58] Field of Search ..... 47/41.01, 41.1, 41.11, 47/41.13, 41.14; 248/911

[56] References Cited

U.S. PATENT DOCUMENTS

| | | | |
|---|---|---|---|
| 1,465,636 | 8/1923 | Gmelin | 47/41.13 |
| 1,491,925 | 4/1924 | Rosenwald | 47/41.11 |
| 1,491,926 | 4/1924 | Rosenwald | 47/41.11 |
| 1,918,785 | 7/1933 | Rosenwald | 47/41.11 |
| 1,947,702 | 2/1934 | Field | 47/41.13 |
| 1,965,565 | 7/1934 | Bartlett | 47/41.13 |
| 2,381,253 | 8/1945 | Bierwert | 47/41.11 |
| 2,407,507 | 9/1946 | Mitchell | 47/41.11 |
| 2,834,153 | 5/1958 | Fearn | 47/41.13 |
| 3,093,145 | 6/1963 | Yamada | 47/41.13 |
| 3,447,262 | 6/1969 | Uhl | 47/41.11 |

FOREIGN PATENT DOCUMENTS

| | | | |
|---|---|---|---|
| 296583 | 9/1928 | United Kingdom | 47/41.11 |

OTHER PUBLICATIONS

A magazine article entitled "Gerberas, Proper Care Insures Beautiful Blossoms" by Christy. Holstead-Klink published in Florist Review in the Sep. 1991 Issue.

*Primary Examiner*—Henry E. Raduazo
*Attorney, Agent, or Firm*—Keith A. Cushing

[57] ABSTRACT

A flower care, storage and display device is shown and illustrated wherein the device includes a grid-panel and associated leg supports for mounting the display device upon a display bucket in such manner that the grid-panel height relative to the bucket floor is greater than the bucket rim height relative to the bucket floor. The display device allows greater stem length in the hydration, storage and display of flower products relative to that otherwise available with standard storage and display buckets. By allowing greater stem length in the hydration and display of flower products, the present invention avoids stem damage, but does not require loss of stem length. The device also makes more of the flower visible during hydration and display for an improved overall display presentation.

8 Claims, 2 Drawing Sheets

FLOWER CARE, STORAGE AND DISPLAY DEVICE

BACKGROUND OF THE INVENTION

The present invention relates generally to display and storage devices, and particularly to flower storage and display devices as used by florists.

The price for a given flower is generally a function of flower stem length. The longer the stem, the higher the price. Long flower stems allow greater versatility in flower arrangements. For this reason, flowers with long stems are more valuable to florists. Preservation of stem length in the care, display and storage of flower products maximizes revenue available from a given flower. Thus, a florist will always preserve the maximum stem length of a given flower in order to maximize revenue from that flower product.

Most flowers are shipped to floral shops in a dehydrated condition. It is necessary for the florist to then store and display the flowers in display bucket which must both hydrate the flowers and provide an acceptable storage and display arrangement. Generally, the flowers are stored and displayed in what will be called herein a "storage bucket" which allows the bottom end of the stem to rest within a body of water in order to hydrate the flower while the flower is stored and displayed in the floral shop. These storage and display buckets used by florists are decorative buckets appropriate for display of flowers to customers, not just general purpose utility buckets. Thus, storage buckets for a florist must be of a certain type of bucket suitable for use in the presentation of flower products for sale. There is a limited selection of such buckets typically available to florists and there are standard sized storage buckets used in most shops.

Many flower varieties are particularly susceptible to damage during hydration, storage and display. For example, the Gerbera Daisy has very long stems, but is susceptible to damage if not properly handled during rehydration. It is important that the stem of the flower be maintained in a desired condition, i.e., straight, when hydrating the flower. If the flower hydrates in a drooped or crooked condition, the stem will assume this shape and the flower will lose value or become useless altogether. It is important, therefore, that the flowers be rehydrated in a straight-stem condition. In this regard, it is important that the bottom end of the stem not rest on the bottom of the storage bucket. If the weight of the flower rests at the stem end on the bucket floor, stem damage and product loss results.

It is known to provide a grid-like structure, e.g., by tape or wire, at the top edge or rim of a storage bucket. The flower stem is inserted through the grid openings. The flower head rests against the grid-like structure in such manner to maintain the weight of the flower against the grid-like structure, rather than the stem resting against the bucket floor. In use of a grid-like structure resting upon the storage bucket rim, the florist typically must cut the stem length to a length less than the height of the standard storage and display bucket. Thus, stem length is typically sacrificed to prevent stem damage during hydration, storage and display.

In another aspect of the storage and display of flower products in a florist shop, it is important that the customer have as much visibility of the flower product as possible. If the customer can see more of the flower the customer need not then rummage through a collection of flowers looking for a suitable selection. Unfortunately, under prior methods of care, storage and display only the flower head is visible and the customers tend to rummage through, and therefore to some extent damage, the flower products when seeking a suitable flower selection.

The subject matter of the present invention addresses these problems of suitable flower care and storage during rehydration, storage and display.

SUMMARY OF THE INVENTION

In accordance with a preferred embodiment of the present invention, a flower care, storage and display device is provided by a grid-panel having legs extending downward therefrom and supporting the grid-panel well above a display bucket. The legs may engage the display bucket rim in such manner that the grid-panel is supported a given distance above the rim of the bucket. In use of the storage and display device of the present invention, stem length need not be sacrificed to avoid stem damage during hydration, storage and display because the space separating the grid-panel and the bucket floor, i.e., that distance defining the maximum stem length, is not restricted to the height of the standard display bucket. Under the present invention the florist can suitably hydrate, store and display such flowers with maximum stem length in order to maximize revenue from the flower product. Furthermore, because the grid-panel is well spaced from the bucket, more of the flower, i.e., the stem portion below the flower head, is made visible relative to prior hydration, storage and display methods.

According to one aspect of the present invention, the grid-panel is provided with a set of legs which are adaptable to a variety of display and storage bucket diameters whereby one flower care, storage and display device of the present invention may be used with versatility on a given range of display bucket diameters.

The subject matter of the present invention is particularly pointed out and distinctly claimed in the concluding portion of this specification. However, both the organization and method of operation of the invention, together with further advantages and objects thereof, may best be understood by reference to the following description taken with the accompany drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
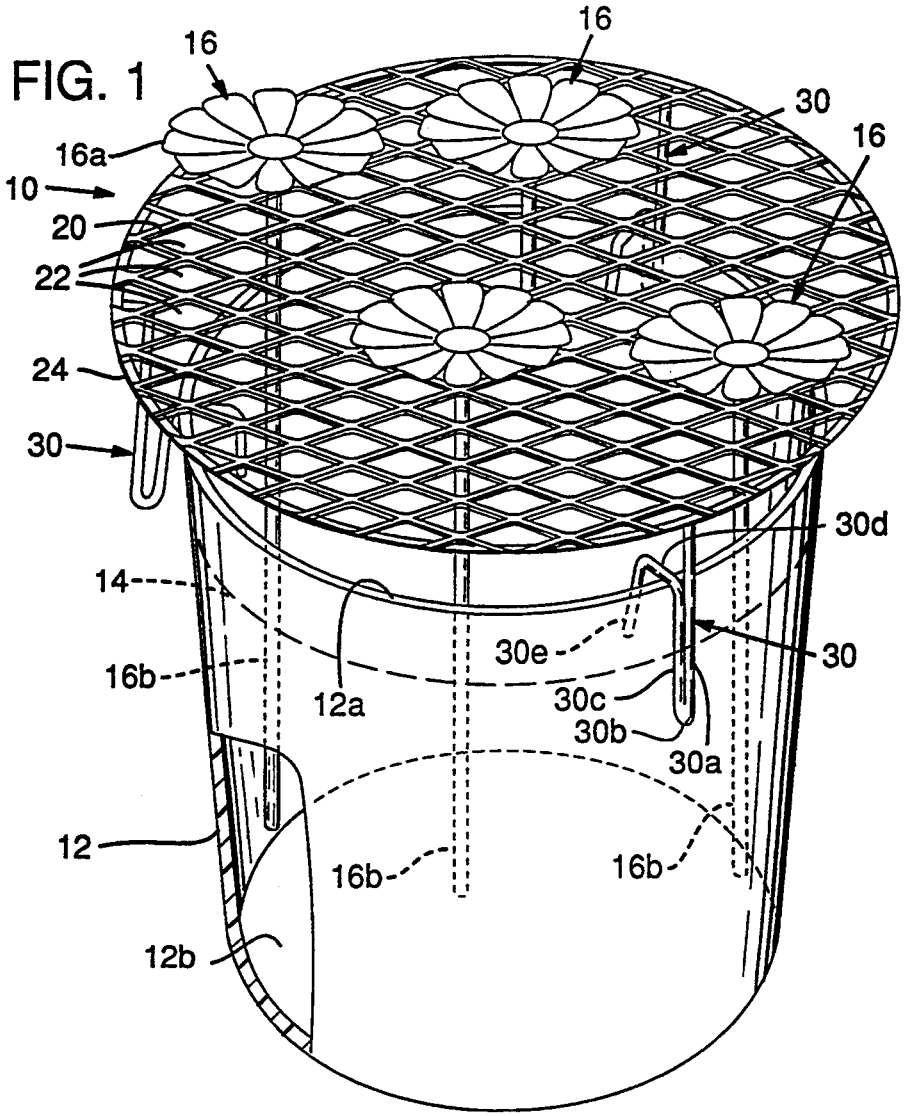
FIG. 1 illustrates in perspective a flower care, storage and display device according to a preferred embodiment of the present invention including a grid-panel with support legs resting upon a storage bucket and a group of flowers supported by the device for hydration and display.
Figure 2:
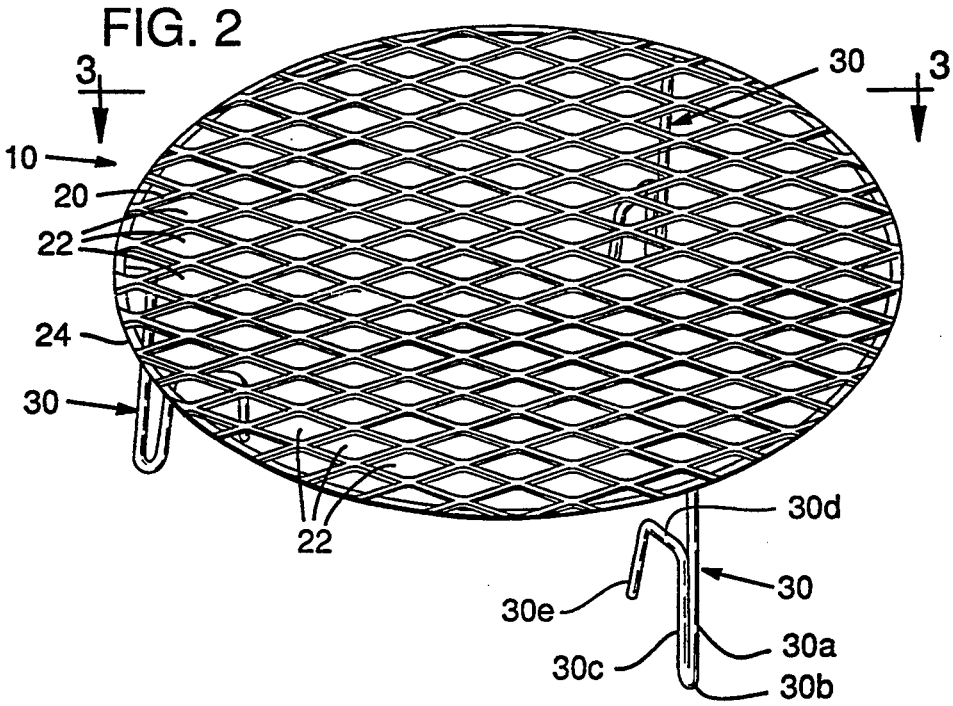
FIG. 2 illustrates a perspective view of the device of FIG. 1 apart from the display bucket and flowers.
Figure 3:
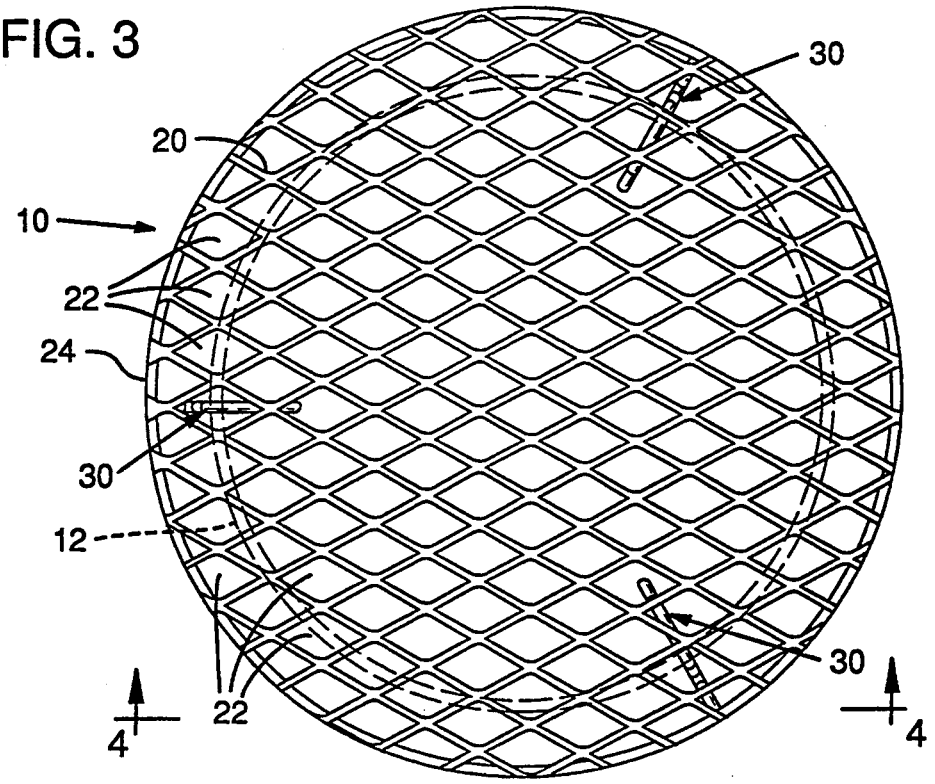
FIG. 3 is a top view of the display device of the present invention as taken along lines 3—3 of FIG. 2.
Figure 4:
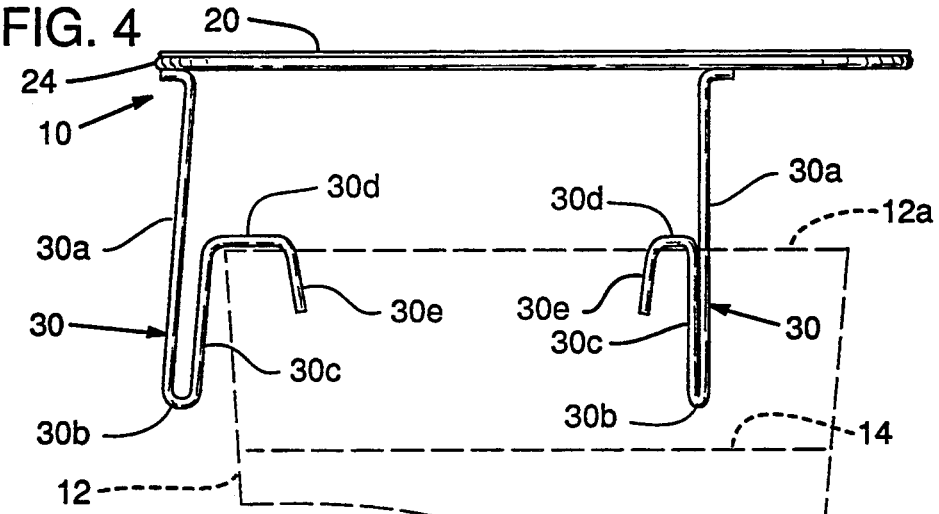
FIG. 4 is a side view of the device of the present invention as taken along lines 4—4 of FIG. 1.

In FIGS. 1 and 2, the preferred embodiment of the present invention as illustrated in the drawings comprises a flower care, storage and display device 10 which rests upon a display bucket 12 and supports an inventory of Gerbera Daisy flowers 16 by supporting the flower weight at the flower head 16*a* and allowing the stems 16*b* to hang freely into a body of water 14 within the storage bucket 16. The device 10 allows suitable hydration, storage and display of flower products without requiring the cutting of stem length to accommodate the height of display bucket 12.

The flower stems 16*b* extend through a grid-panel 20 of the device 10. The openings 22 are of suitable diameter to allow passage of flower stems 16*b*, but not flower heads 16*a*. The device 10 thereby supports the weight of flowers 16 at the flower heads 16*a*, rather than the flower stems 16*b* bearing against the floor 12*b* of the bucket 12. The grid-panel 20 is surrounded by a supporting ring 24. The grid-panel 20 may be provided by conventional expanded steel stock, and the grid-ring by conventional round stock suitably bent into circular configuration.

Device 10 includes a set of support legs 30 each extending downward from the undersurface of the grid-panel 20 for engagement of the bucket rim 12*a* in such manner to more widely separate the grid-panel from the floor 12*b* of the bucket 16. By so extending the space between the grid-panel 20 and the bucket floor 12*b*, greater stem length is allowed during hydration, storage and display. The device 10 thereby preserves stem length and increases revenue from the sale of flowers 16. Also, because the grid-panel 20 is spaced from the bucket rim 12*a*, the upper end of flower stems 16*b* are more visible. In this manner device 10 improves the overall display presentation available during hydration, storage and display of flowers 16.

Each leg 30 includes a downward extending length portion 30*a* which attaches, e.g., by welding, to the grid ring 24. In the preferred embodiment of the present invention, the length portion 30*a* is inclined slightly relative to a vertical axis (not shown) to provide a downward and outward orientation for each length portion 30*a* relative to the vertical axis. The lower end of each length portion 30*a* terminates at a 180° turn portion 30*b*. The portion 30*b* then continues into a second length portion 30*c*, substantially parallel to but shorter than the length portion 30*a*. Portion 30*c* then supports another length portion 30*d*, maintained substantially perpendicular to the portion 30*c*, which in turn supports a third length portion 30*e* which is maintained at approximately 105° and in downward orientation relative to the length portion 30*d*. The entire leg 30, including each of the specified length portions, is contained in a common plane and provides support for the grid-panel 30 relative to the bucket rim 30*a*.

Device 10 includes three such legs 30 equally spaced about the circumference of the ring 24. In placing the device 10 upon the bucket 12, the portions 30*a*, 30*b* and 30*c* of legs 30 rest outside the bucket 12 and the portion 30*d* rests upon the bucket rim 12*a*. The portion 30*e* of each leg 30 then resides within the bucket 12 and aids in maintaining the device 10 upon the bucket 12. By provision of the length portion 30*d* the device 10 accommodates variation in the diameter of bucket 12, i.e., a given range of bucket diameters may be accommodated according to the length magnitude of the portions 30*d* of each leg 30.

In the preferred embodiment of the present invention, the relative spacing between the grid-panel 20 and the bucket rim 12*a* is on the order of 3 inches. Also in the preferred embodiment, the device 10 is provided with a powder coating finish for improved wear and appearance. An additional 3 inches of stem length is thereby allowed in rehydrating the flowers 16 relative to that possible under prior methods of rehydration and display. As may be appreciated, by providing greater separation between the grid-panel 20 and the bucket 12*a*, i.e., by use of longer legs 30, greater stem length may be preserved if necessary. In particular, greater stem length may be preserved for a given bucket 12 height, or similar stem length may be maintained but for use with buckets of lesser height. Thus the height of grid-panel 20 above bucket rim 12*a* may vary according to flower stem length relative to bucket 12 height. In either case, the present invention preserves available stem length of flowers 16 during hydration, storage and display.

Figure 5:
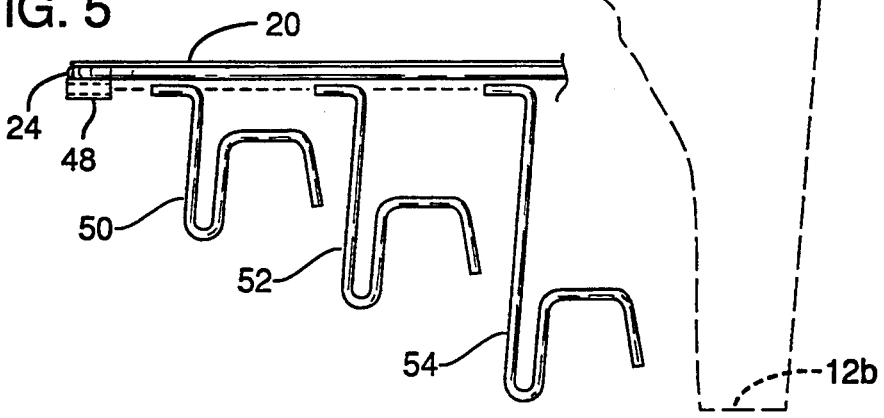
FIG. 5 is a partial view of the device of the present invention according to a second embodiment showing the detachability and variation in length of the support legs.

FIG. 5 illustrates a second embodiment of the present invention having detachable support legs for the purpose of more compact storage of the device, and also variation in support leg length in order to accommodate a given stem length and a given bucket height. In FIG. 5, a portion of the device 10 is shown in side view, i.e., a portion of the ring 24 and the grid 20, with a collar 48 welded to the underside of ring 24. Three such collars 48 are equally spaced about the circumference of ring 24 in order to provide a mounting location for three support legs. FIG. 5 also shows three support legs which may be mounted to the collar 48. The support legs 50, 52 and 54 are each of different length and may be used to provide a variation in spacing between the grid-panel and the bucket rim 12*a*. Thus, if a separation corresponding to that provided by support leg 50 is desired, then three such support legs 50 would be mounted to the collars 48 of the device 10 in order to suitably support to the grid-panel 20 above the bucket rim 12*a*. Similarly, three such support legs 52 or three such support legs 54 may be used according to a selected spacing between the bucket rim 12*a* and the grid-panel 20. While only three such lengths of support legs are shown, it will be understood that the present invention encompasses a greater variety in the selection of support leg length, and therefore a greater variety in the selected spacing between the grid-panel 20 and the bucket rim 12*a*.

The typical stem length for Gerbera Daisies is between 12 and 30 inches and the typical height for display buckets used by florists averages approximately 18 inches. Thus, under the present invention greater stem length may be preserved in the care, storage and display of flower products in a florist shop.

Thus an improved flower care, storage and display device has been shown and described. The display device of the present invention retains value in flower products by maintaining flower stem length. The present invention further provides greater visibility of flower products in the display thereof, and thereby reduces the need for rummaging through the flower display by customers in selecting flowers from the display. Overall, the present invention provides both greater revenue from flower products and also improved presentation of flower products in the display to customers.

It will be appreciated that the present invention is not restricted to the particular embodiment that has been described and illustrated, and that variations may be made therein without departing from the scope of the invention as found in the appended claims and equivalence thereof.

What is claimed is:

1. A flower storage and display device in combination with a display bucket for storing and displaying flowers having a flower head and a flower stem, said display bucket having a bucket floor and a bucket rim, said device comprising:

a grid-panel corresponding approximately in size and shape to said bucket and including grid openings of sufficient size to allow passage of said flower stems therethrough but not allow passage of said flower heads therethrough whereby said flower heads may rest against said grid-panel and said flower stems may depend freely therebelow; and legs downwardly extending from said grid-panel and engaging said bucket rim and supporting said grid-panel at a predetermined position above said bucket rim, whereby the maximum length of said flower stems as positioned depending freely from said grid-panel is greater than the distance between said bucket rim and said bucket floor.

2. A device according to claim 1 wherein said legs include substantially horizontal bucket engaging member whereby said device is supported by said engaging members resting upon said bucket rim.

3. A device according to claim 2 wherein said bucket engaging members include weight bearing portions maintained in fixed spaced relation to said grid-panel and resting upon said bucket rim so as to maintain said grid-panel in fixed spaced relation to said bucket rim.

4. A device according to claim 3 wherein said weight bearing portions are substantially parallel to said grid-panel and are of sufficient length to allow limited variation in diameter of said bucket rim.

5. A device according to claim 1 wherein said legs are removably attached to said grid-panel, and when attached establish said predetermined position.

6. A device according to claim 5 wherein said device includes a plurality of such removably detachable legs, said plurality of legs providing variation in length to provide selected predetermined spacing between said grid-panel and said bucket rim.

7. A flower hydration, storage and display arrangement for flowers having a flower head and a flower stem, the arrangement comprising:

a display bucket having a given height defined by a distance separating a bucket floor and a bucket rim, the bucket containing a body of water;

a grid-panel corresponding approximately in size and shape to said bucket and defining grid-openings of sufficient size to allow passage of said flower stems therethrough but not allow passage of said flower heads therethrough whereby each of said flowers may be supported from the grid-panel by passing said flower stem through one of said openings and allowing the flower head to rest against the grid-panel with the flower stem depending freely therebelow; and legs extending downward from said grid-panel and having bucket engaging members resting against said bucket rim of said bucket in such manner that a predetermined height of said grid-panel relative to said bucket floor is greater than the given height of said bucket.

8. A device according to claim 7 wherein said bucket engaging members are substantially parallel to said grid-panel and are of sufficient length to allow limited variation in diameter of said bucket rim.

* * * * *